US005482392A

United States Patent [19]

Asano et al.

[11] Patent Number: 5,482,392

[45] Date of Patent: Jan. 9, 1996

[54] RECORDING APPARATUS FOR CHANGING THE AMOUNT OF DISPLACEMENT AND THE TIMING OF DISPLACEMENT OF AN ERASING MEMBER

[75] Inventors: Shinya Asano, Tokyo; Tetsuya Kawanabe, Yokohama, both of Japan

[73] Assignee: Canon Kabushiki Kaisha, Tokyo, Japan

[21] Appl. No.: 389,621

[22] Filed: Feb. 15, 1995

Related U.S. Application Data

[63] Continuation of Ser. No. 286,392, Aug. 5, 1994, which is a continuation of Ser. No. 135,127, Oct. 12, 1993, abandoned, which is a continuation of Ser. No. 810,455, Dec. 19, 1991, abandoned, which is a continuation of Ser. No. 438,989, Nov. 20, 1989, abandoned, which is a continuation of Ser. No. 133,781, Dec. 16, 1987, abandoned.

[30] Foreign Application Priority Data

| | | | |
|---|---|---|---|
| Dec. 26, 1986 | [JP] | Japan | 61-308365 |
| Dec. 26, 1986 | [JP] | Japan | 61-308366 |
| Mar. 6, 1987 | [JP] | Japan | 62-050145 |

[51] Int. Cl.[6] ..... B41J 29/36; B41J 35/14

[52] U.S. Cl. ..... 400/697; 400/212; 400/216

[58] Field of Search ..... 400/212, 213, 400/216, 216.1, 216.2, 227.2, 232, 240.1, 303, 695, 696, 697, 697.1

[56] References Cited

U.S. PATENT DOCUMENTS

| | | | |
|---|---|---|---|
| 3,154,183 | 10/1964 | Wolowicz | 400/240.1 |
| 3,729,081 | 4/1973 | Ozimek et al. | 400/240.1 |
| 4,453,167 | 6/1984 | Motoyoshi | 400/697.1 |
| 4,606,661 | 8/1986 | Aldrich et al. | 400/227.2 |
| 4,611,938 | 9/1986 | Rettke et al. | 400/212 |
| 4,662,766 | 5/1987 | Teichmann et al. | 400/227.2 |
| 4,692,045 | 9/1987 | Makita | 400/697 |
| 4,708,505 | 11/1987 | Tsumura et al. | 400/697.1 |
| 4,986,677 | 1/1991 | Kondo et al. | 400/187 |

FOREIGN PATENT DOCUMENTS

| | | | |
|---|---|---|---|
| 0186892 | 12/1985 | European Pat. Off. . | |
| 33975 | 4/1981 | Japan | 400/227.2 |
| 162684 | 3/1982 | Japan | 400/212 |
| 84886 | 5/1982 | Japan | 400/232 |
| 169372 | 10/1982 | Japan . | |
| 198283 | 10/1985 | Japan . | |
| 51374 | 3/1986 | Japan . | |
| 206685 | 9/1986 | Japan . | |
| 215081 | 9/1986 | Japan | 400/212 |
| 61-244575 | 10/1986 | Japan | 400/695 |
| 262170 | 11/1986 | Japan . | |
| 295063 | 12/1986 | Japan . | |
| 284475 | 12/1986 | Japan . | |
| 280972 | 12/1986 | Japan . | |
| 9978 | 1/1987 | Japan | 400/697.1 |
| 2138746 | 10/1984 | United Kingdom | 400/697 |

*Primary Examiner*—David A. Wiecking

*Attorney, Agent, or Firm*—Fitzpatrick, Cella, Harper & Scinto

[57] ABSTRACT

A recording apparatus is capable of recording an image on a recording medium and of erasing an image recorded on the recording medium. The apparatus has a recording device such as a print hammer and a drive motor therefor; an erasure tape for erasing the image recorded on the recording medium by the recording device; a shift mechanism for shifting the erasure tape upwardly or downwardly; a circuit for causing the erasure tape to execute a plurality of image erasing operations; a recognition device for recognizing an erasure condition such as the kind of erasure ribbon, the kind of character and the size of a character; and a control circuit for controlling the shift mechanism so that the amount of shift of the erasure tape varies in accordance with the erasure conditions recognized by the recognition device. It is accordingly possible to improve the image erasure function of the apparatus.

27 Claims, 14 Drawing Sheets

RECORDING APPARATUS FOR CHANGING THE AMOUNT OF DISPLACEMENT AND THE TIMING OF DISPLACEMENT OF AN ERASING MEMBER

This application is a continuation of application Ser. No 08/286,392 filed Aug. 5, 1994, which is a continuation of Ser. No. 08/135,127, filed Oct. 12, 1993, which is a continuation of Ser. No. 07/810,455, filed Dec. 19, 1991, which is a continuation of Ser. No. 07/438,989, filed Nov. 20, 1989, which is a continuation of Ser. No. 07/133,781, filed Dec. 16, 1987, all now abandoned.

BACKGROUND OF THE INVENTION

1. Field of the Invention

The present invention relates generally to recording apparatus for recording an image on a recording medium and, more particularly, to a recording apparatus arranged to allow an operator to freely erase an image that has been erroneously recorded on the recording medium.

The term "recording apparatus" used herein embraces electronic typewriters, printers, word processors, copying machines and so forth. The term "image" used herein embraces alphanumerical characters, symbols, and graphic patterns. The term "recording medium" used herein embraces ordinary paper, typing paper, plastic sheets for use with an OHP, and so forth.

2. Related Background Art

In a conventional type of typewriter with a erasure function, in printing, an inked ribbon is shifted to a print position at which the inked ribbon is struck through a desired character to thereby effect printing. Each time one character is printed, a carriage which carries a print head or the inked ribbon is moved at a pitch equivalent to one character. In this print operation, if a character is erroneously printed, the same character as the erroneously printed character is selected and an erasure tape is shifted to the print position. Then, an erasure impact is applied to the surface of the printing paper through the selected character to peel off the ink of the wrong character recorded on the surface of the printing paper. This erasure tape is divided into two major types: one is of a so-called lift-off type that has an adhesive portion which peels off the ink of a wrong character by its adhesive force and the other is of a so-called cover-up type that erases the ink of a wrong character by covering it with white ink.

In an erasure operation, it is difficult to make the position of a printed character coincide with a position at which a character is to be printed for erasure purposes. For this reason, a small unerased portion may be left because of this dislocation. In order to eliminate such unerased portion, it is common practice to apply a plurality of erasure impacts at the erasure position and right and left positions which are slightly offset therefrom.

If the same portion of the erasure tape is repetitively used for the plurality of erasure impacts, the following problems are encountered. In the case of lift-off erasure tapes having an adhesive surface, a small amount of ink which is stuck to a portion of the adhesive tape during a first erasure impact is transferred to the printing paper. In the case of cover-up erasure tapes, since the same portion thereof cannot be used two or more times, it is impossible to achieve complete erasure. For this reason, the erasure or correction tape is shifted a small amount upwardly or downwardly to avoid use of the same portion.

However, even if the erasure tape is controlled to be shifted the same actual amount upwardly or downwardly, the amount of shift of the erasure tape per se is changed by various factors such as the adhesive force of the erasure tape, the hardness or resiliency of the erasure tape, and the speed at which the erasure tape is peeled from printing paper. This leads to the following problems.

In erasing characters such as "I" having a large capital height, if the erasure tape is shifted upwardly or downwardly, the erasure tape is partially offset from the character and an unerased portion may be left. In contrast, in order to solve the problem, it may be considered that the amount of shift of each kind of erasure tape is reduced so that the erasure tape may completely cover the area occupied by the character. As a result, it becomes difficult to shift some kinds of erasure tape and this leads to a lowering in the efficiency of the erasure function of the apparatus.

SUMMARY OF THE INVENTION

It is therefore an object of the present invention to provide an improved recording apparatus in which it is possible to erase an image recorded on a recording medium. In this recording apparatus to which the invention is applied, an erroneously recorded image can be erased and a correct image can be recorded.

It is another object of the present invention to provide an improved recording apparatus in which it is possible to clearly erase an image recorded on a recording medium as compared with related art erasure mechanisms.

It is another object of the present invention to provide an improved recording apparatus in which it is possible to peel off an image recorded on a recording medium.

It is another object of the present invention to provide an improved recording apparatus having an erasure function which is improved by changing the amount of shift of an erasure tape in accordance with the kind of erasure tape such as a cover-up erasure tape or a lift-off erasure tape.

It is another object of the present invention to provide an improved recording apparatus having an image erasure function which is improved by changing the amount of shift of an erasure tape in accordance with the size of a recorded image to be erased.

It is another object of the present invention to provide an improved recording apparatus having an erasure function which is improved by changing the amount of shift of an erasure tape in accordance with the kind of typestyle (for example, type wheel) of a recorded image.

It is another object of the present invention to provide an improved recording apparatus in which it is possible to positively erase a recorded image by using an erasure tape.

In achieving these and other objects, in accordance with present invention, there is provided a recording apparatus capable of recording an image on a recording medium and as required of erasing an image recorded on the recording medium, comprising recording means for recording an image on the recording medium; an erasure member for erasing the image recorded on the recording medium by the recording means; displacement means for displacing the erasure member; execution means for causing the erasure member to execute a plurality of image erasing operations; recognition means for recognizing an erasure condition; and control means for controlling the displacement means so that the amount of displacement of the erasure member varies in accordance with the erasure conditions recognized by the recognition means.

The present invention further provides a recording apparatus capable of recording an image on a recording medium and of using an erasure ribbon to erase an image recorded on the recording medium, comprising identification means for identifying the kind of the erasure ribbon; displacement means for displacing the erasure ribbon between a stand-by position and an erasure position at which an erasure operation is performed; execution means for causing the erasure ribbon to execute a plurality of erasure-operations; and control means for varying the amount of breadthwise displacement of the erasure ribbon between the successive erasure operations executed by the execution means in accordance with the kind of erasure ribbon identified by the identification means. The identification means may be arranged to identify the size or kind of a character.

Further objects, features and advantages of the present invention will become apparent from the following description of preferred embodiments of the present invention taken with reference to the accompanying drawings.

DETAILED DESCRIPTION OF THE PREFERRED EMBODIMENTS

Preferred embodiments of the present invention will be described in detail with reference to a typewriter to which the invention is applied.

EMBODIMENT I

A first preferred embodiment which will be described hereinbelow is intended to improve the capability to erase an image by varying the amount of shift of erasure tape in accordance with the kind of erasure tape.

(CONSTRUCTION OF EMBODIMENT I (FIGS. 1 and 2))

Figure 1:
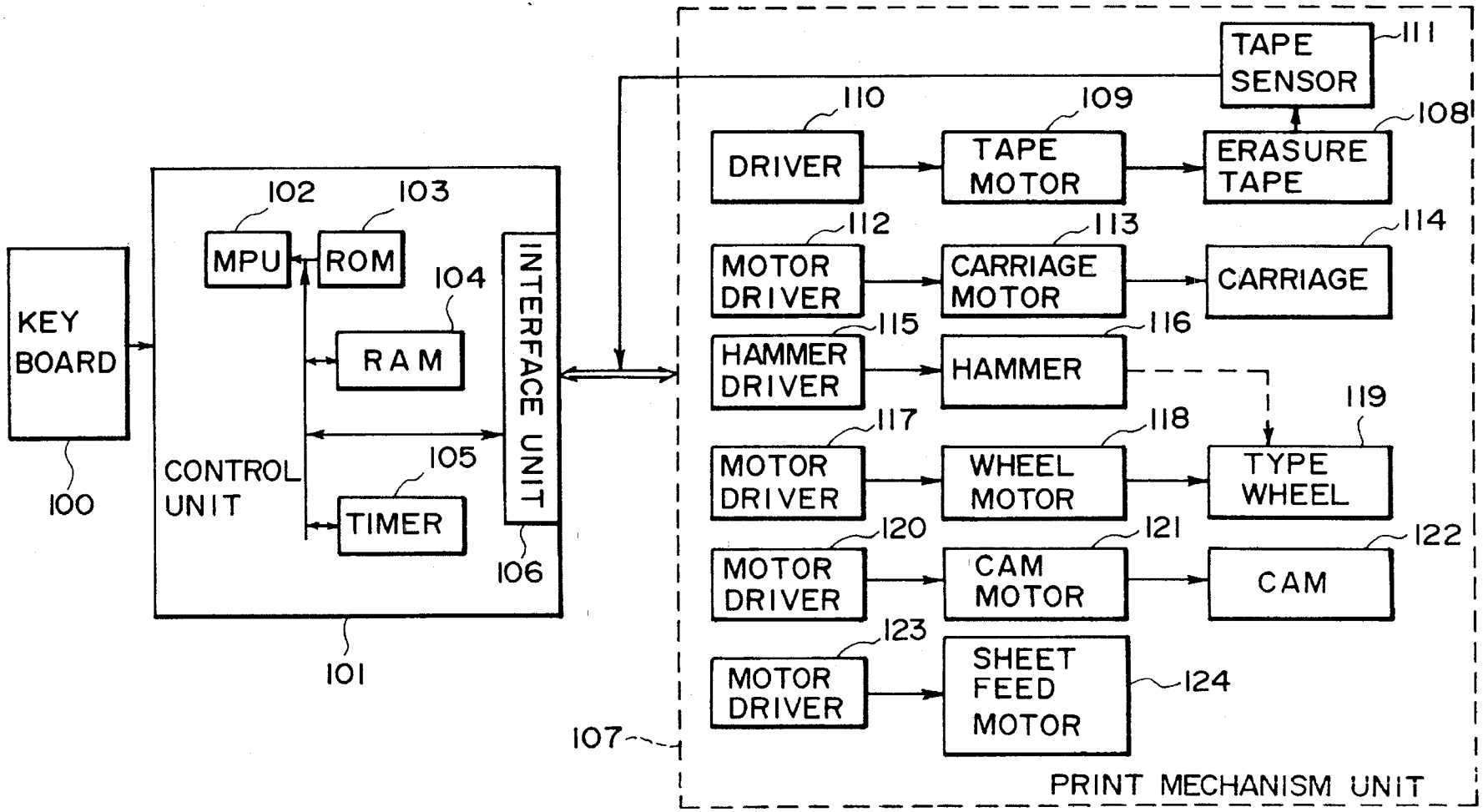
FIG. 1 is a block diagram illustrating the construction of a typewriter which incorporates one preferred embodiment of the present invention.

FIG. 1 is a block diagram illustrating the construction of the first preferred embodiment which is used in a typewriter.

As illustrated, a keyboard 100 has character input keys and various function keys, and is used to input print data and various kinds of instruction data. A control unit 101 controls the entire mechanism of the typewriter such as that illustrated in FIG. 2, and includes a ROM 103 for storing a control program or programs, an MPU 102 such as a microprocessor for outputting various control signals in accordance with the control program or programs stored in the ROM 103 to provide control over the entire mechanism, a RAM 104 used as a work area for the MPU 102, a timer 105 for counting on the basis of instruction signals supplied from the MPU 102, and an interface unit 106 for outputting drive signals supplied from the MPU 102 to motor drivers or hammer drivers of a print mechanism unit 107, the interface unit 106 transmitting and receiving various signals to and from the print mechanism unit 107.

The following is a description of the print mechanism unit 107 for performing a print operation.

An erasure tape 108 which is used to erase a printed character is fed by a predetermined amount by a tape motor 109 driven by a driver 110. A tape sensor 111 is a sensor for detecting the kind of erasure tape which is currently placed in the body of the typewriter. The tape sensor 111 is used to discriminate between a so-call lift-off erasure tape and a so-called cover-up erasure tape on both of which are in an erasure tape cartridge loaded in the typewriter. The lift-off erasure tape is of the type in which its adhesive portion is stuck to the ink of a printed character and peeled therefrom, thereby erasing the printed character. The cover-up erasure tape is of the type which, for example, the white ink thereof is applied to a printed character to be erased. It is to be noted that the keyboard 100 may be arranged to specify the kind of erasure tape 108.

A motor driver 112 drives a carriage motor 113 for transporting a carriage 114 which carries a print head to cause the carriage 114 to travel along the length of a platen. When the carriage 114 reaches a position for printing, a wheel motor 118 causes a type wheel 119 to rotate about its axis, thereby selecting a desired one of characters 41 of the type wheel 119. A hammer driver 115 causes the hammer 116 to strike the back of the selected character portion of the type wheel 119 and thus the desired character 41 is printed on a sheet of paper through an inked ribbon 33. For erasure of a printed character, after the carriage 114 has been moved to a position corresponding to that of the printed character, an instruction representative of character erasure is input through the keyboard 100 and a key corresponding to the printed character is depressed to re-enter the same character, thereby selecting the character portion of the type wheel 119 corresponding to the key input. The thus-selected character is printed through the erasure tape 108 by the hammer 116. In this manner, the printed character is peeled from the sheet or covered by white ink and one cycle of character erasure is completed. Incidentally, a motor drive 117 is arranged to drive the wheel motor 118 to cause the type wheel 119 to rotate a predetermined amount so as to select a desired one among the characters 41.

A cam 122 is provided for varying the inclination of a ribbon frame for carrying the inked ribbon 33 and the erasure tape 108 to displace the inked ribbon 33 or the erasure tape 108 to a position corresponding to a character portion of the type wheel 119. The cam 122 is driven by a cam motor 121 driven by a motor driver 120. A sheet feed motor 124 causes the platen to rotate to perform sheet feed, and is driven by a motor driver 123.

Figure 2:
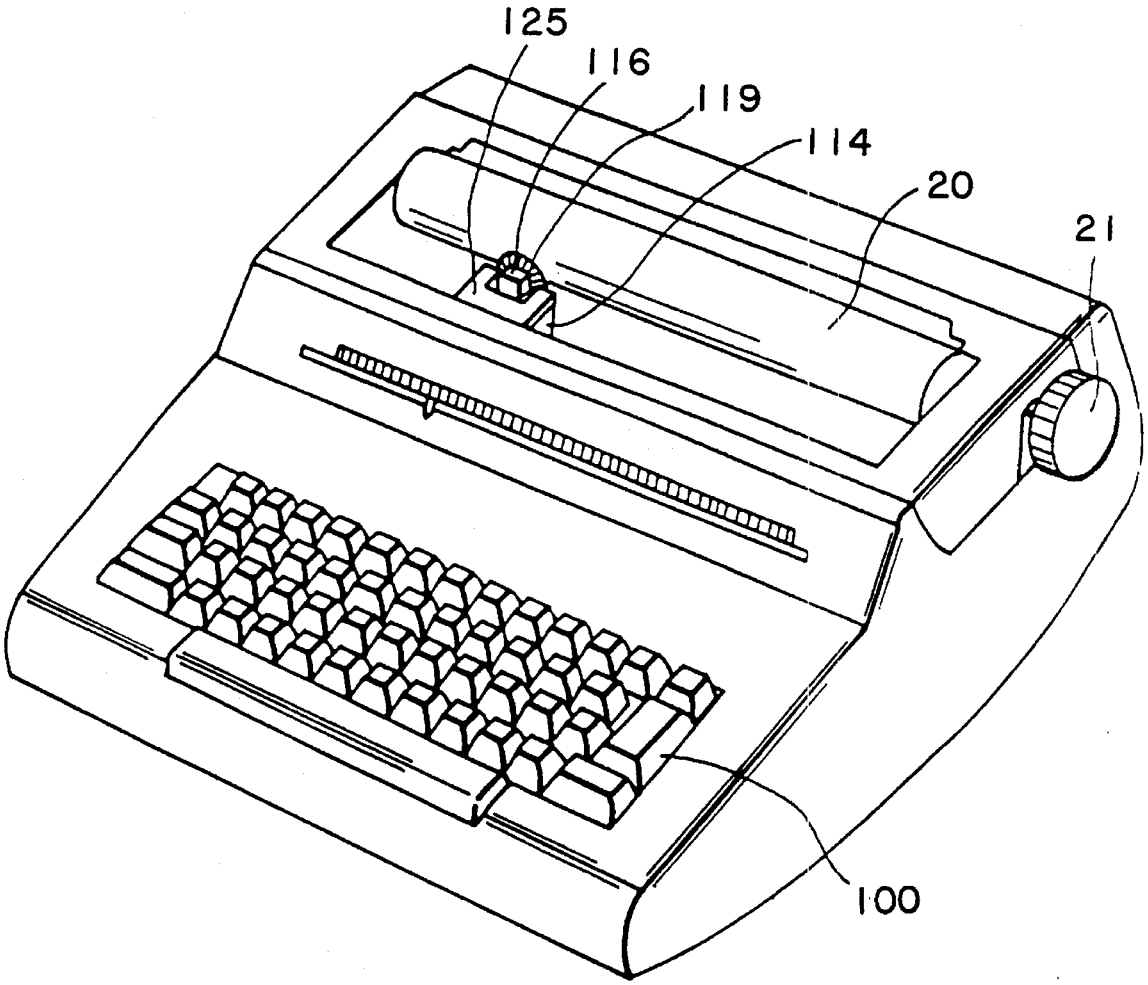
FIG. 2 is a diagrammatic perspective view of the appearance of the typewriter illustrated in FIG. 1.

FIG. 2 diagrammatically illustrates in perspective the appearance of the typewriter which incorporates the first preferred embodiment, in which reference numerals are used to denote like or corresponding elements relative to those shown in FIG. 1.

A platen 20 is driven by the sheet feed motor 124 to feed a sheet which is partially wrapped around the platen 20, and serves as a recording roller for receiving the impact of a stroke by the hammer 116. The keyboard 100 having various input keys is used to input a character or the like to be recorded on the sheet or an instruction representative of the erasure operation of erasing a specified one or ones of the characters recorded on the sheet.

The carriage 114 carries the hammer 116 serving as a record head, the type wheel 119 such as a daisy wheel having a group of radially arranged character portions, a ribbon cassette 125 in which the inked ribbon 33 is accommodated, and a supply spool 36 carrying a roll of erasure tape 108. The carriage motor 113 causes the carriage 114 to move a desired distance to the left or right, substantially parallel to the longitudinal axis of the platen 20. It is to be noted that a knob 21 is manually turned to feed the sheet.

(SHIFT MECHANISM FOR INKED RIBBON AND ERASURE TAPE (FIGS. 3 and 4))

Figure 3:
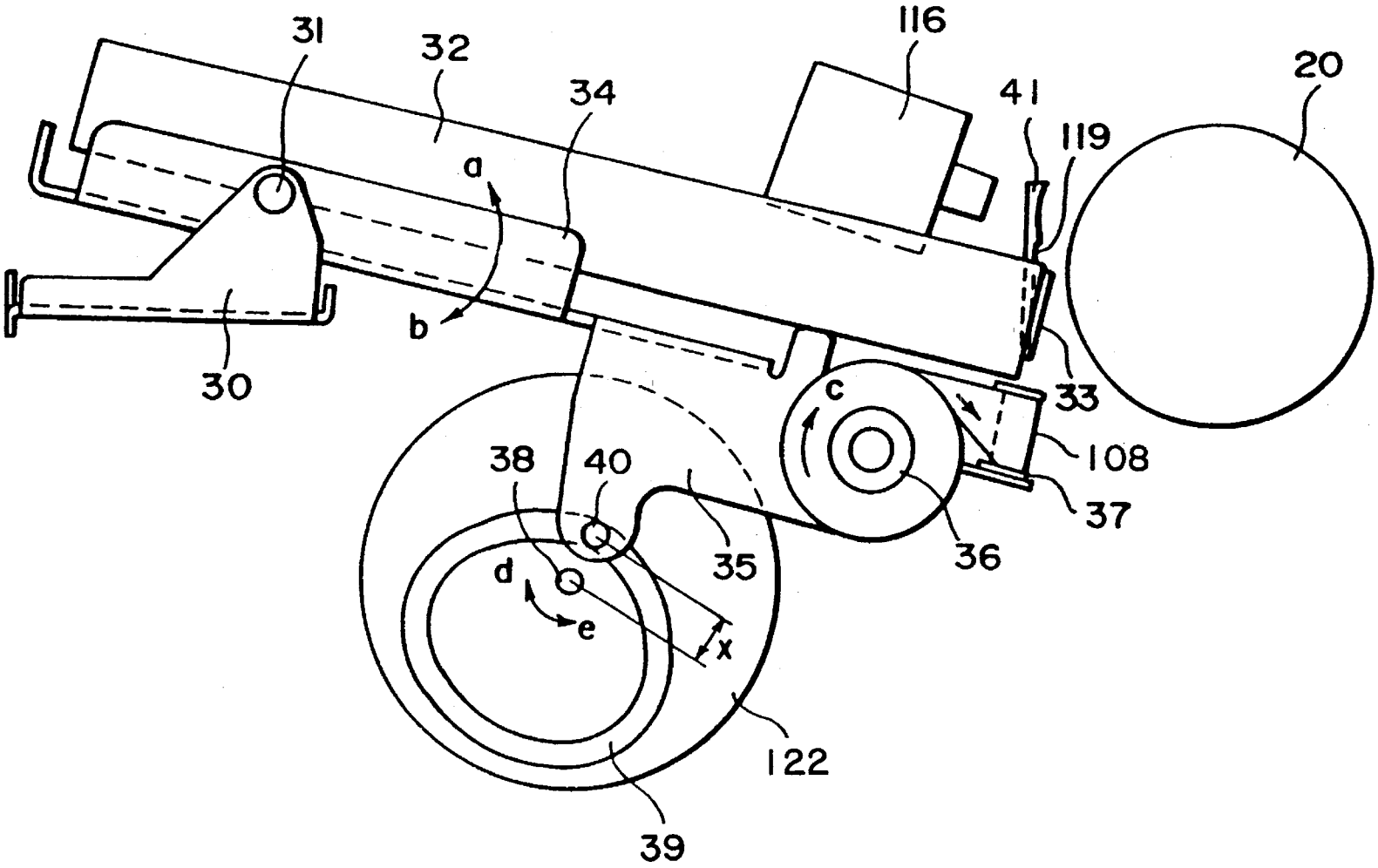
FIG. 3 is a schematic side elevation of a shift mechanism for an inked ribbon and an erasure tape in the present invention, and illustrates a non-print mode in which the ribbon is moved to its lower position.
Figure 4:
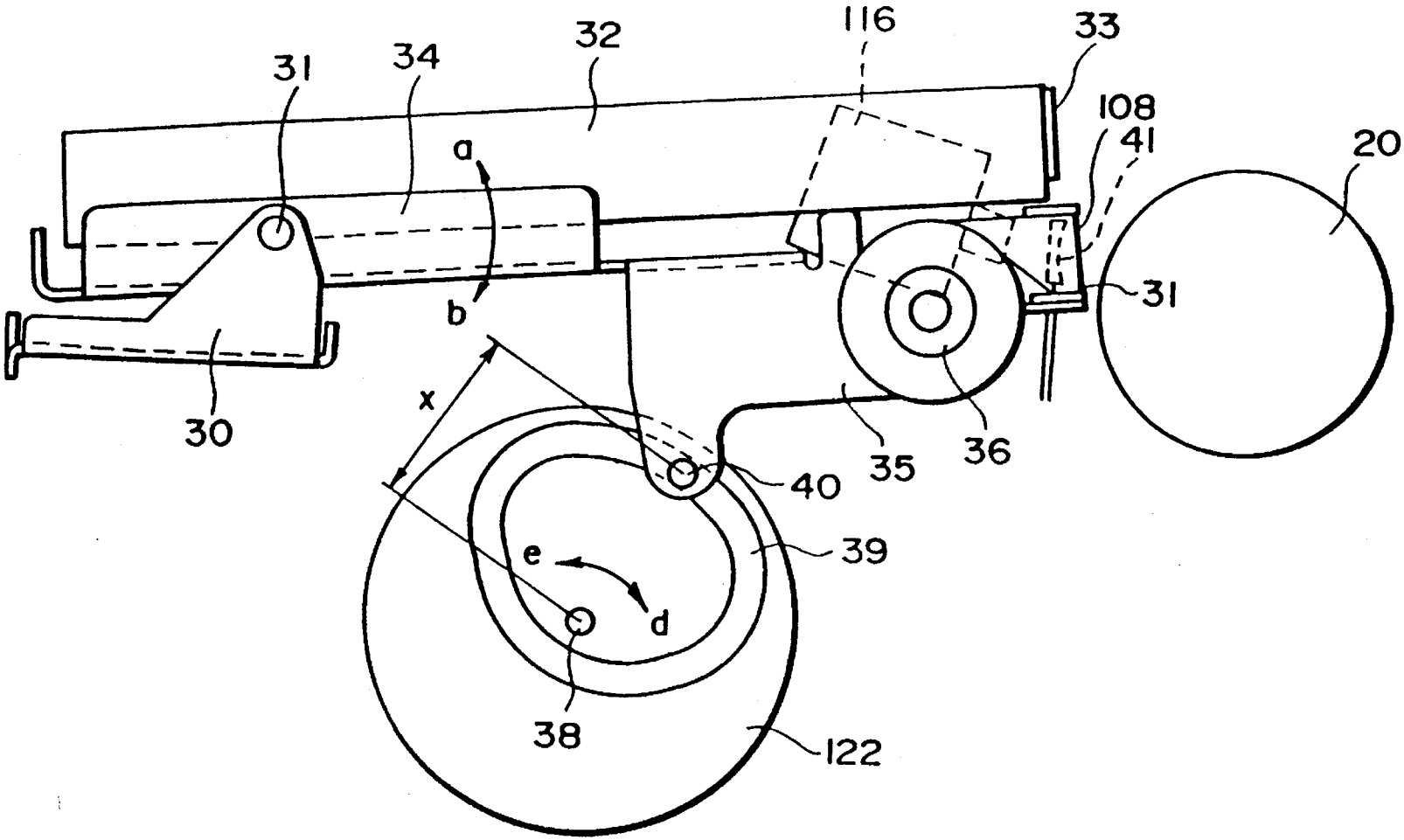
FIG. 4 is a view similar to FIG. 3, illustrating a manner in which the erasure tape is lifted up to a position corresponding to that of a character.

FIGS. 3 and 4 are schematic views illustrating a shift mechanism for the inked ribbon 33 and the erasure tape 108. In FIG. 3 showing a non-print mode, the ribbon 33 is moved to its lower position while, in FIG. 4, the erasure tape 108 is lifted up to a position corresponding to that of the character 41. In FIGS. 3 and 4, like reference numerals are used to denote like or corresponding elements relative to those in FIGS. 1 and 2 as well as the other drawings which will be referred to later.

In FIG. 3, the ribbon cassette 32 which accommodates the inked ribbon 33 is detachably carried by a ribbon frame 34. This ribbon frame 34 is supported by a support member 30 provided on the carriage 114 for pivotal movement about a shaft 31 in the directions of arrows a and b. Extensions 35 (one of which is shown) extend downwardly from opposite sides of the forward end portion of the ribbon frame 34 which faces the platen 20. The illustrated extension 35 is provided with the supply spool 36 having a roll of the erasure tape 108 which is not used. The other extension 35 (not shown) is provided with a take-up spool around which the used portion of the erasure tape 108 is to be wound by the drive of the tape motor 109.

A guide roller 37 for guiding travel of the erasure tape 108 is provided in the vicinity of each of the aforesaid spools. The erasure tape 108 is fed from the supply spool 36 while being twisted by an angle of 90° , and is tightly disposed between the guide rollers 37 on opposite sides. The rotational drive of the tape motor 109 causes the take-up spool to rotate and wind the used portion of the erasure tape 108 therearound. Simultaneously, the supply spool 36 is pulled and rotated in the direction of an arrow C to feed a portion of the erasure tape 108 which has a length corresponding to that of the used portion that has been wound around the take-up spool.

A cam 122 is rotated about a shaft 38 by the cam motor 121. The cam 122 has a cam groove 39 for slidably receiving a pin 40 which projects from the inner surface of a lower end portion of the extension 35. Therefore, when the cam 122 is rotated in the directions of arrows a and b, the distance X between the shaft 38 of the cam 122 and the pin 40 is varied. Thus, the ribbon frame 34 is pivoted about the shaft 31 in the directions of arrows a and b to displace the inked ribbon 33 or the erasure tape 108 to the position corresponding to that of the character 41 of the type wheel 119.

Referring to FIG. 4, the distance X between the shaft 38 and the pin 40 is increased by the rotation of the cam 122 so that the ribbon frame 34 is lifted up in the direction of the arrow a, thereby locating the erasure tape 108 at such a position as to allow the tape to cover the character 41. In this state, when the hammer 116 strikes the erasure tape 108 through the back of the character 41, the ink of a printed character is peeled off by being transferred to the erasure tape 108, or the printed character is covered by white ink. In this fashion, erasure of the desired character is completed.

In a normal print operation, the rotation position of the cam 122 is varied so as to locate the inked ribbon 33 at a position such as to allow the ribbon to cover the character 41. In this state, the hammer 116 is driven so as to strike the back of the character 41. In this fashion, the ink of the struck portion of the inked ribbon is transferred to a sheet and the desired character is printed.

As described above, as the cam 122 rotates, the distance X gradually varies in accordance with the eccentric rotation of the cam groove 39. Thus the erasure tape 108 is gradually and continuously displaced from the position shown in FIG. 3 to the position shown in FIG. 4 in association with rotation of the cam 122. Accordingly, if the cam 122 is rotated a small amount when the ribbon frame 34 is located at a position approximate to that shown in FIG. 4, the tightly disposed portion of the erasure tape 108 is shifted a small amount in the direction of the breadth of the erasure tape 108 (in the vertical direction). Therefore, the rotational position of the cam 122 can be varied to locate the erasure tape 108 at a given position relative to the character 41.

For instance, when one erroneously printed character is to be erased with three strokes of the hammer 116, the erasure tape 108 is shifted a small amount in the downward direction between the first and second ones of the three strokes. In this case, the amount of rotation of the cam 122 is controlled in accordance with the kind of erasure tape 108 to vary the amount of shift of the erasure tape 108. More specifically, in a case where the erasure tape 108 is of an adhesive type that is neither easily peeled from printing paper nor shifted vertically, the cam 122 is rotated a somewhat large amount so as to cause the erasure tape 108 to be positively shifted. In another case where the erasure tape 108 is of a cover-up type that is easily shifted without the need to rotate the cam 122 a large amount and that exhibits high effectiveness in erasure with a small amount of shift, the cam 122 is controlled to be rotated a small amount.

(CHARACTER ERASURE OPERATION (FIG. 5))

Figure 5:
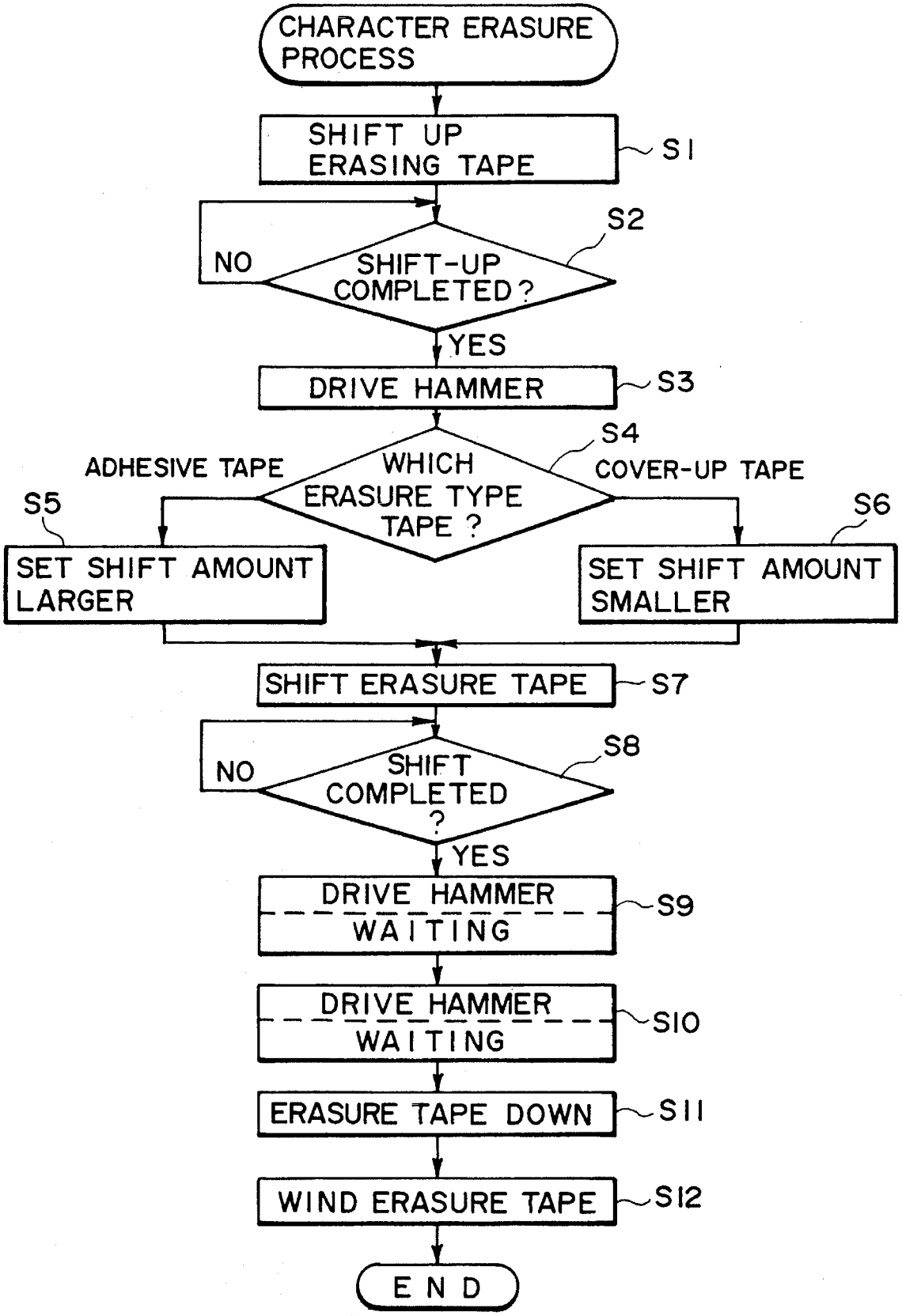
FIG. 5 is a flow chart of a character erasure process executed in the embodiment shown in FIG. 1.

FIG. 5 is a flow chart illustrating the character erasure processing program which is stored in the ROM 103 of the control unit 101. In starting the present program, after an instruction representative of character erasure has been input, the carriage 114 is moved to the position corresponding to a character whose erasure is desired, and the same one as the character to be erased is input through the keyboard 100.

In Step 1, the cam 122 is rotated to shift up the erasure tape 108 to the position corresponding to that of the character 41 as shown in FIG. 4. In Step S2, on the basis of counts of the timer 105 a judgment is made as to whether this shift-up operation has been completed. When the shift-up operation is completed, the process proceeds to Step S3 provided for effecting an erasure operation in which the hammer driver 115 causes the hammer 116 to strike the back of the character 41. The impact which the character 41 applies to the printed character through the erasure tape 108 enables the ink of the printed character to be transferred from the paper to an adhesive portion of the erasure tape 108 or the printed character to be covered by white ink, thereby performing erasure of the printed character.

In this case, however, the printed character is not entirely erased with a single application of the impact. For this reason, the erasure tape 108 is shifted a small amount upwardly or downwardly to perform the following applications of erasure impact.

After the hammer 116 has been driven in Step S3, the process waits for the erasure tape 108 to be peeled off with reference to the count of the timer 105. In Step S4, the kind of the erasure tape 108 is detected. This detection may be performed through the tape sensor 111 on the basis of the configuration of the cartridge or the supply spool for the erasure tape 108. For example, predetermined codes indicative of the kind of erasure tape may well be stored in the RAM 104 through the keyboard 100 or the like.

As described above, the erasure tape 108 is divided into two kinds: one is of an adhesive type which peels off a printed character by its adhesivenss and the other is of a cover-up type which covers a printed character with white ink. If the erasure tape 108 is of the adhesive type, the process proceeds to Step S5 in which the amount of shift of the erasure tape 108 (the amount of rotation of the cam 122) is set to a large value. On the other hand, if the erasure tape 108 is judged to be of the cover-up type, the process proceeds to Step S6 in which the amount of shift is set to a small value.

In Step S7, the cam 122 is rotated the amount that has been set in Step S5 or S6 so that the erasure tape 108 is shifted a small amount upwardly or downwardly. In Step S8, on the basis of the count of the timer 105, a judgement is made as to whether this shift has been completed. When the shift is completed, the process proceeds to Step S9 in which the hammer 116 is driven to effect a second stroke against the character 41. In Step S10, the process waits for the erasure tape 108 to be peeled from the printed surface of the paper and, after it has peeled off, the process a third impact.

It is to be noted that, in order to achieve a further improved erasure function, the carriage 114 may be moved a small distance to the left or right between the first and second applications of impact and between the second and third applications of impact (between Step S9 and S10). In a similar manner to the vertical shift performed between the first and second application of impact, the erasure tape 108 may be shifted a small amount upwardly or downwardly between the second and third application of impact. For example, if the erasure tape 108 has been shifted upwardly in Step S7, it may of course be shifted upwardly.

After having waited in Step S10 for the erasure tape 108 to be peeled off, the process proceeds to Step S11 in which the cam 122 is rotated to move the erasure tape 108 downwardly as shown in FIG. 3. In Step S12, the tape motor 109 is driven by the driver 110 so that the erasure tape 108 is wound a predetermined amount, thereby completing the entire process.

It is to be noted that the time period for which the above-described erasure tape 108 is waiting for the erasure tape 108 to be peeled off may be changed, for example, in accordance with the kind of erasure tape. As one example, in a case where the erasure tape 108 is of a cover-up type, the time required for the application of erasure impact can be shortened.

The first embodiment has been described above with reference to the typewriter employing a type wheel by way of example. However, the present invention is not limited solely to the above example. For example, the invention is of course applicable to various other types of recording apparatus such as a thermal transfer printer which effects recording employing a thermal transfer ribbon.

As described above, in the first embodiment, the erasure function can be further improved since the amount of shift which is required of the erasure tape between successive applications of erasure impact can be varied in accordance with the kind (characteristics) of erasure tape. In addition, since the character is entirely covered by the erasure tape, it is possible to solve various problems such as variations in the effectiveness of erasure and imperfect erasure which might be caused by the difference in kind of erasure tape.

Moreover, since it is possible to utilize the portion of the erasure tape which is normally not used in the related art, efficient and effective use of the erasure tape becomes possible, and this provides advantages from the economic viewpoint.

EMBODIMENT II

Still another embodiment of the present invention will be described below with reference to FIGS. 6 to 8. In the following description, like reference numerals are used to denote like or corresponding members relative to those used in the first embodiment, and the previous descriptions performed in connection with FIGS. 2 and 4 are applied to the description of this embodiment.

In brief, the embodiment which will be described later is intended to improve the capability to erase an image by varying the amount of shift of the erasure tape in accordance with the size of a recorded image to be erased.

This embodiment will be described in more detail below with reference to FIGS. 6 to 8.

(CONSTRUCTION OF EMBODIMENT II (FIGS. 6 to 8))

Figure 6:
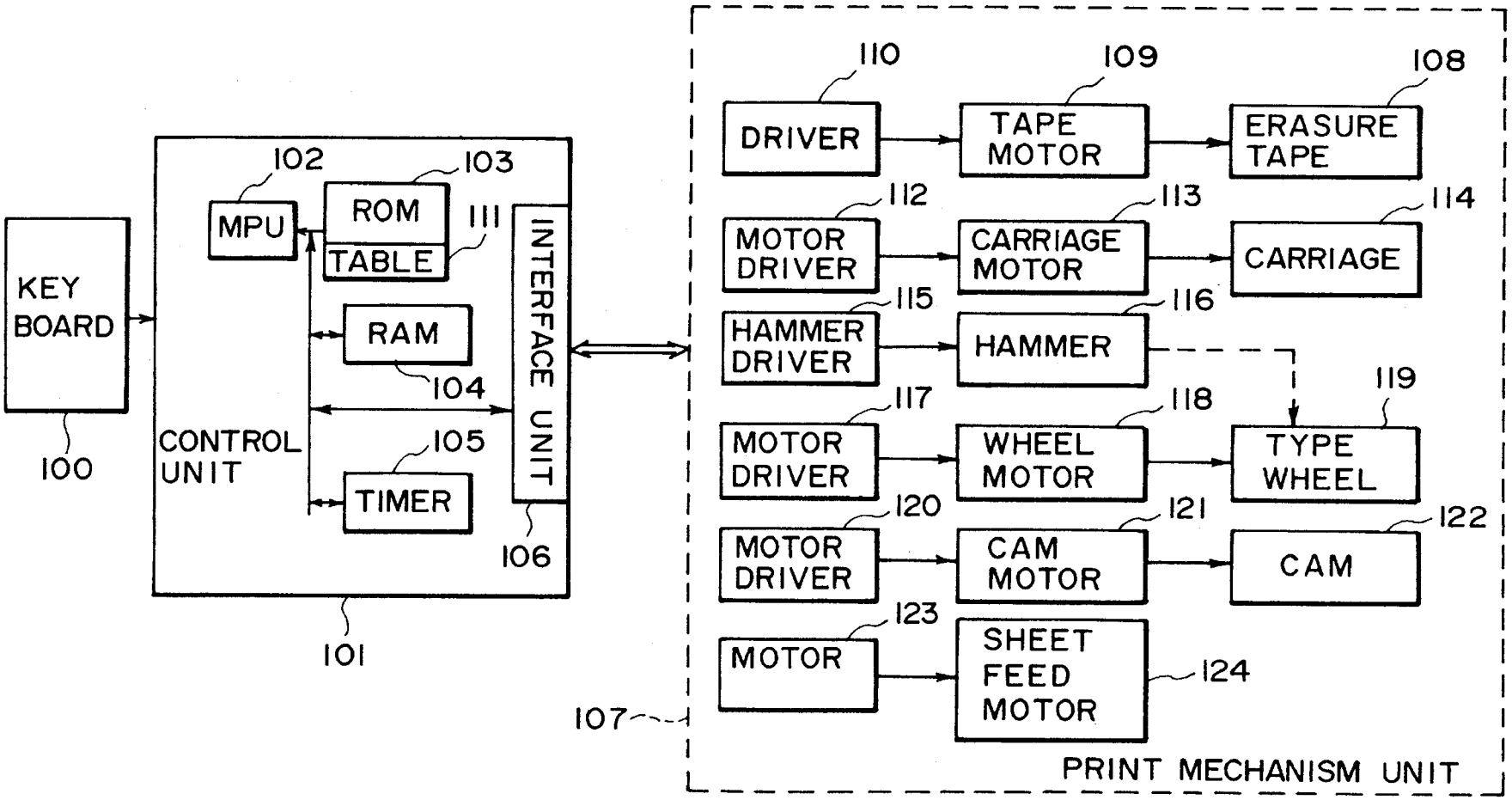
FIG. 6 is a block diagram illustrating the construction of a typewriter which incorporates another preferred embodiment of the present invention.

FIG. 6 is a block diagram illustrating the construction of the second preferred embodiment which is used in a typewriter.

As illustrated, the keyboard 100 having character input keys and various function keys is used to input print data and various kinds of instruction data. The control unit 101 controls the entire mechanism of the typewriter such as that illustrated in FIG. 2, and includes the ROM 103 for storing a control program or programs, the MPU 102 such as a microprocessor for outputting various control signals in accordance with the control program or programs stored in the ROM 103 to provide control over the entire mechanism, the RAM 104 used as a work area for the MPU 102, the timer 105 for counting on the basis of instruction signals supplied from the MPU 102, and the interface unit 106 for outputting drive signals supplied from the MPU 102 to motor drivers or hammer drivers of the print mechanism unit 107, various signals being communicated between the interface unit 106 and the print mechanism unit 107.

In the second embodiment having the foregoing construction, the amount of shift of the erasure tape 108 is varied by means of the shift mechanism shown in FIGS. 3 and 4 in correspondence with the size of a printed character to be erased.

Figure 7:
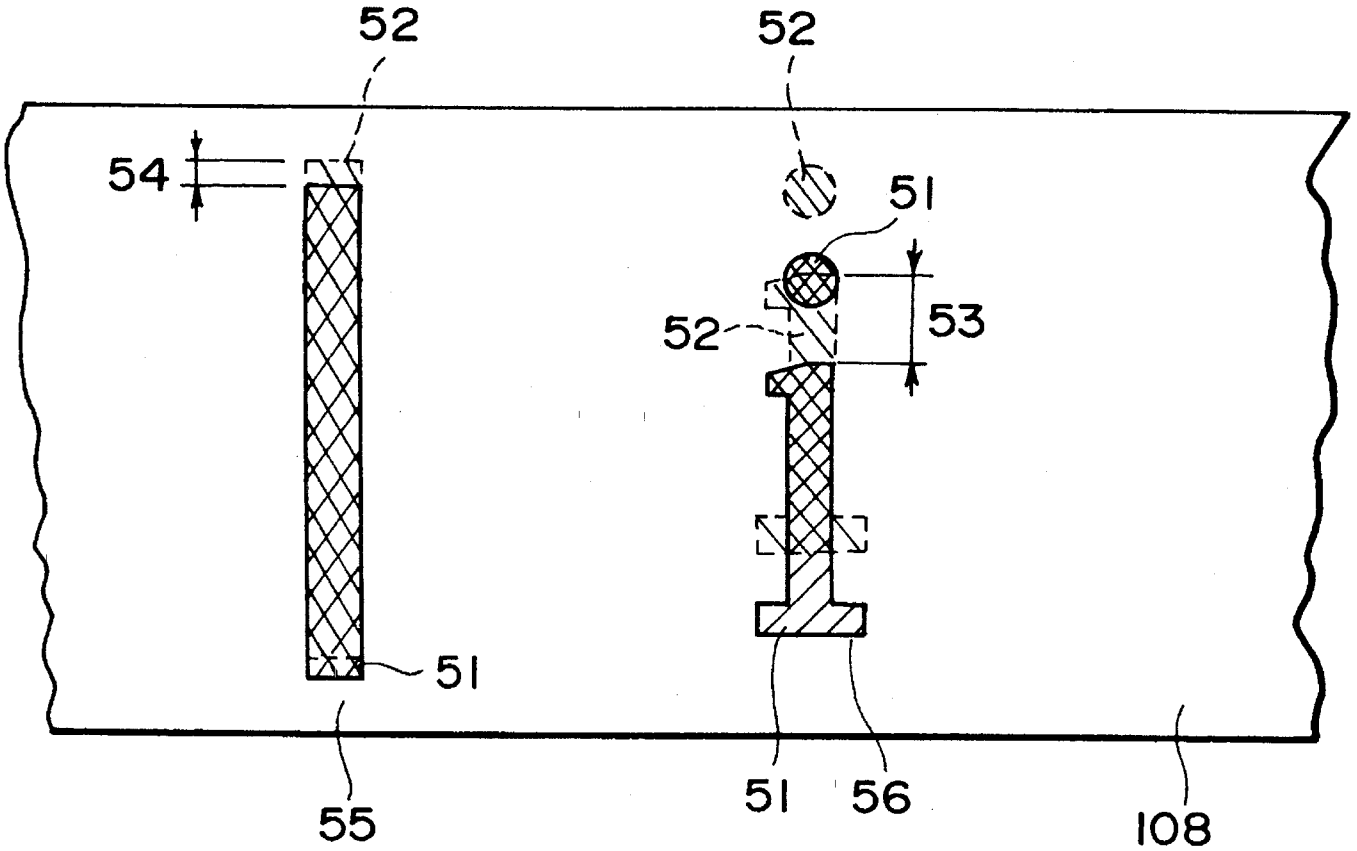
FIG. 7 is a schematic illustration of the relative positions of an erasure tape and characters to be erased in the present invention.

FIG. 7 illustrates the relationship between the erasure tape 108 and a character to be erased.

As illustrated, a capital "I" having a large capital height is indicated at 55 while a capital "i" having a relatively small capital height is indicated at 56. The portion which is impacted by a first cycle of erasure operation is indicated at 51 and the portion which is impacted by a second cycle of erasure operation is indicated at 52. As is evident from FIG. 7, if the erasure tape 108 is shifted vertically with respect to the capital "I" in an amount equivalent to that of shift with respect to the capital "i", the capital height of the capital "I" cannot entirely be covered by the erasure tape 108, and this leads to imperfect erasure. For this reason, the amount of rotation of the cam 122 is controlled so that the amount of shift of the erasure tape 108 with respect to the capital "I" between the first and second cycles of erasure operation, that is, the amount of shift indicated as 54 is set to about 0.2 mm and so that the same amount with respect to the capital "i" between the same cycles, that is, the amount of shift indicated as 53 is set to about 0.8 mm.

(CHARACTER ERASURE OPERATION (FIG. 8))

Figure 8:
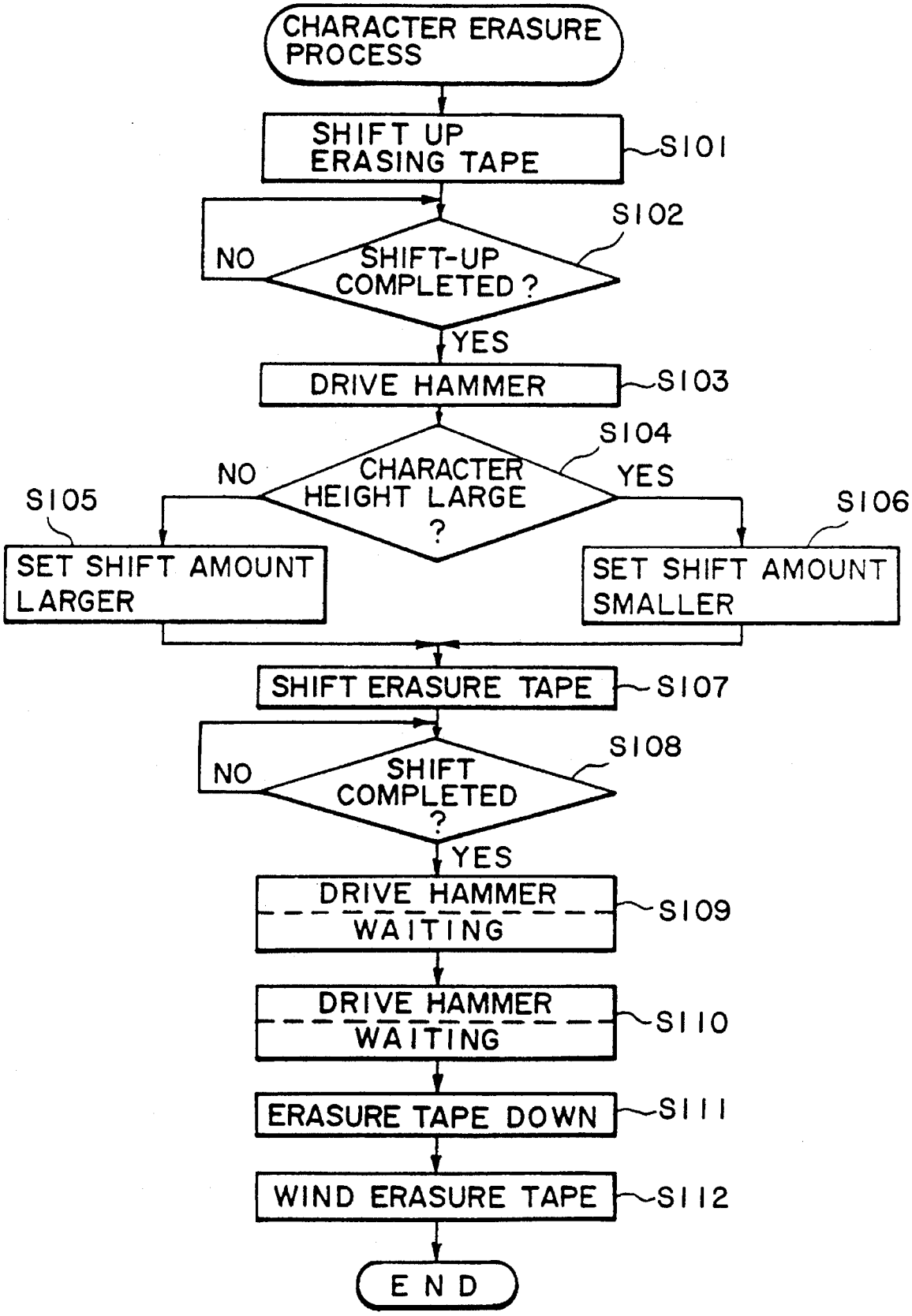
FIG. 8 is a flow chart of a character erasure process executed in the embodiment shown in FIG. 6.

FIG. 8 is a flow chart illustrating the character erasure processing program which is stored in the ROM 108 of the control unit 101. In starting the present program, after an instruction representative of character erasure has been input, the carriage 114 is moved to the position corresponding to a character whose erasure is desired, and the same one as the character to be erased is input through the keyboard 100.

In Step 101, the cam 122 is rotated to shift up the erasure tape 108 to the position corresponding to that of the character 41 as shown in the previously-mentioned FIG. 4. In Step S102, on the basis of counts of the timer 105 a judgment is made as to whether this shift-up operation has been completed. When the shift-up operation is completed, the process proceeds to Step S103 provided for effecting an erasure operation in which the hammer driver 115 causes the hammer 116 to strike the back of the character 41. The impact which the character 41 applies to the printed character through the erasure tape 108 enables the ink of the printed character to be transferred from the paper to an adhesive portion of the erasure tape 108 or the printed character to be covered by white ink, thereby performing erasure of the printed character.

In this case, however, the printed character is not entirely erased with a single application of erasure impact. For this reason, the erasure tape 108 is shifted a small amount upwardly or downwardly to perform the following applications of erasure impact.

After the hammer 116 has been driven in Step S103, the process waits for the erasure tape 108 to be peeled off with reference to the count of the timer 105. In Step S104, the character size of a specified character to be erased is determined with reference to a table 111 stored in the ROM 103. For example, if the specified character has a small capital height, the process proceeds to Step S105 in which the amount of shift of the erasure tape 108 (the amount of rotation of the cam 122) is set to a large value. On the other hand, if the character specified in Step S104 has a large capital height, the process proceeds to Step S106 in which the amount of shift of the erasure tape 108 is set to a small value.

In Step S107, the cam 122 is rotated the amount that has been set in Step S105 or S106 so that the erasure tape 108 is shifted a small amount upwardly or downwardly. In Step S108, on the basis of the count of the timer 105, a judgement is made as to whether this shift has been completed. When the shift is completed, the process proceeds to Step S109 in which the hammer 116 is driven to effect a second stroke against the character 41. In Step S110, the process waits for the erasure tape 108 to be peeled from the printed surface of the paper and, after it has peeled off, a third application of erasure is performed.

It is to be noted that, in order to achieve a further improved erasure function, the carriage 114 may be moved a small distance to the left or right between the first and second applications of impact and the second and third applications of impact (between Step S109 and Step S110). In a similar manner to the vertical shift performed between the first and second applications of impact, the erasure tape 108 may be shifted a small amount upwardly or downwardly between the second and third applications of impact. For example, if the erasure tape 108 has been shifted upwardly in Step S107, it may of course be shifted upwardly.

After having waited in Step S110 for the erasure tape 108 to be peeled off, the process proceeds to Step S111 in which the cam 122 is rotate to move the erasure tape 108 downwardly as shown in the previously-mentioned FIG. 3. In Step S112, the tape motor 109 is driven by the driver 110 so that the erasure tape 108 is wound a predetermined amount, thereby completing the entire process.

It is to be noted that the time period for which the above-described erasure tape 108 is waiting for the erasure tape 108 to be peeled off may be changed, for example, in accordance with the kind of erasure tape. As one example, in a case where the erasure tape 108 is of a cover-up type, the time required for the application of erasure impact can be shortened.

The first embodiment has been described above with reference to the typewriter employing a type wheel by way of example. However, the present invention is not limited solely to the above example. For example, the invention is of course applicable to various other types of recording apparatus such as a thermal transfer printer which effect recording employing a thermal transfer ribbon.

As described above, in the first embodiment, the effectiveness of erasure can be improved since the amount of shift which is required of the erasure tape between successive applications of erasure impact can be varied in accordance with the kind of a character to be erased (for example, character size). In addition, since the character is entirely covered by the erasure tape, it is possible various problems such as variations in the effectiveness of erasure and imperfect erasure can be solved.

Moreover, since it is possible to utilize the portion of the erasure tape which is normally not used in the related art, efficient and effective use of the erasure tape becomes possible, and this provides advantages from the economic viewpoint.

EMBODIMENT III

Still another embodiment will be described below with reference to FIGS. 9 to 14. For the purpose of illustration, it is assumed hereinafter that this embodiment is incorporated in the typewriter illustrated in FIG. 12 and the shift mechanism shown in FIGS. 13 and 14.

The third embodiment which will be described below is intended to improve the capability to erase an image by varying the amount of shift of an erasure tape in correspondence with the kind of the typestyle (for example, the kind of type wheel) of a recorded image. More specifically, in the third embodiment, the amount of shift of the erasure tape or correction tape is reduced with respect to printed characters having a typestyle whose capital height is large to entirely cover the printed characters with the erasure or correction tape, thereby preventing the printed character from remaining non-corrected. In the case of erasure of printed character having a typestyle whose capital height is small, the correction type is shifted a somewhat large amount to improve the effectiveness of erasure.

(CONSTRUCTION OF EMBODIMENT III)

Figure 12:
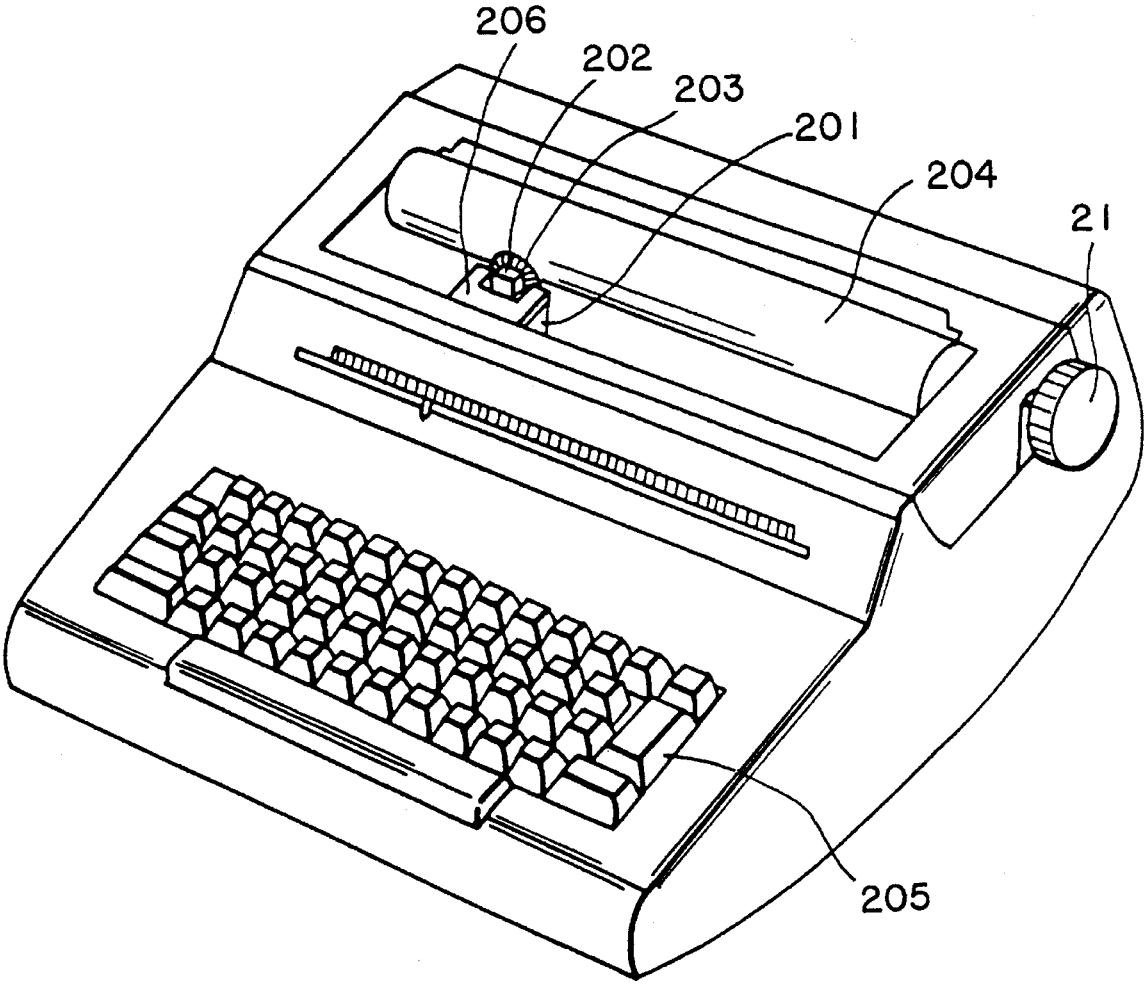
FIG. 12 is a diagrammatic perspective view of the appearance of the typewriter illustrated in FIG. 9.

As illustrated in FIG. 12, in this embodiment as well, a carriage 201 carries a print hammer 202 which constitutes a part of a record head, a daisy wheel 203 having radially disposed characters, a ribbon cassette 206 which accommodates an inked ribbon. The carriage 201 is driven by a drive means (not shown) to move parallel to the longitudinal axis of a platen 204 for recording by main scan.

A plurality of type wheels 203 for individual typestyles of characters are supplied and therefor, since the detachable type wheels 203 are changed, it is possible to print a desired typestyle. Accordingly, when the type wheels 203 are changed, the height, size or the like of each character varies in correspondence with the typestyle.

In the third embodiment, the previously-mentioned distance X gradually varies in accordance with the eccentric rotation of a cam groove 210a. Thus the erasure tape 208 is gradually and continuously displaced from the position shown in FIG. 13 to the position shown in FIG. 14. Accordingly, if a cam 210 is rotated a small amount when the ribbon frame 34 is located at a position approximate to that shown in FIG. 14, the tightly disposed portion of the erasure tape 208 is shifted a small amount in the direction of the breadth of the erasure tape 208 (in the vertical direction).

In other words, the rotational position of the cam 210 can be varied to freely control the height of the tightly disposed portion of the erasure tape 208, thereby locating a given breadthwise (vertical) portion of the tightly disposed portion at a striking position.

Accordingly, in a system requiring a plurality of erasure strokes, for example, a system in which one erroneously printed character is erased with three strokes of a print hammer and in which the erasure tape 208 is shifted a small amount downwardly between the first and second strokes of the three, the amount of rotation of the cam 122 is controlled between the first and second stroke of the print hammer so that the erasure tape 208 may be shifted a predetermined amount such as to enable any typestyle 203 a of the character, that is, any kind of the type wheel 203 to be entirely covered by the erasure tape 208.

The following is a description of the control system of the typewriter incorporating the third embodiment for effecting the above-described erasure operation.

Figure 9:
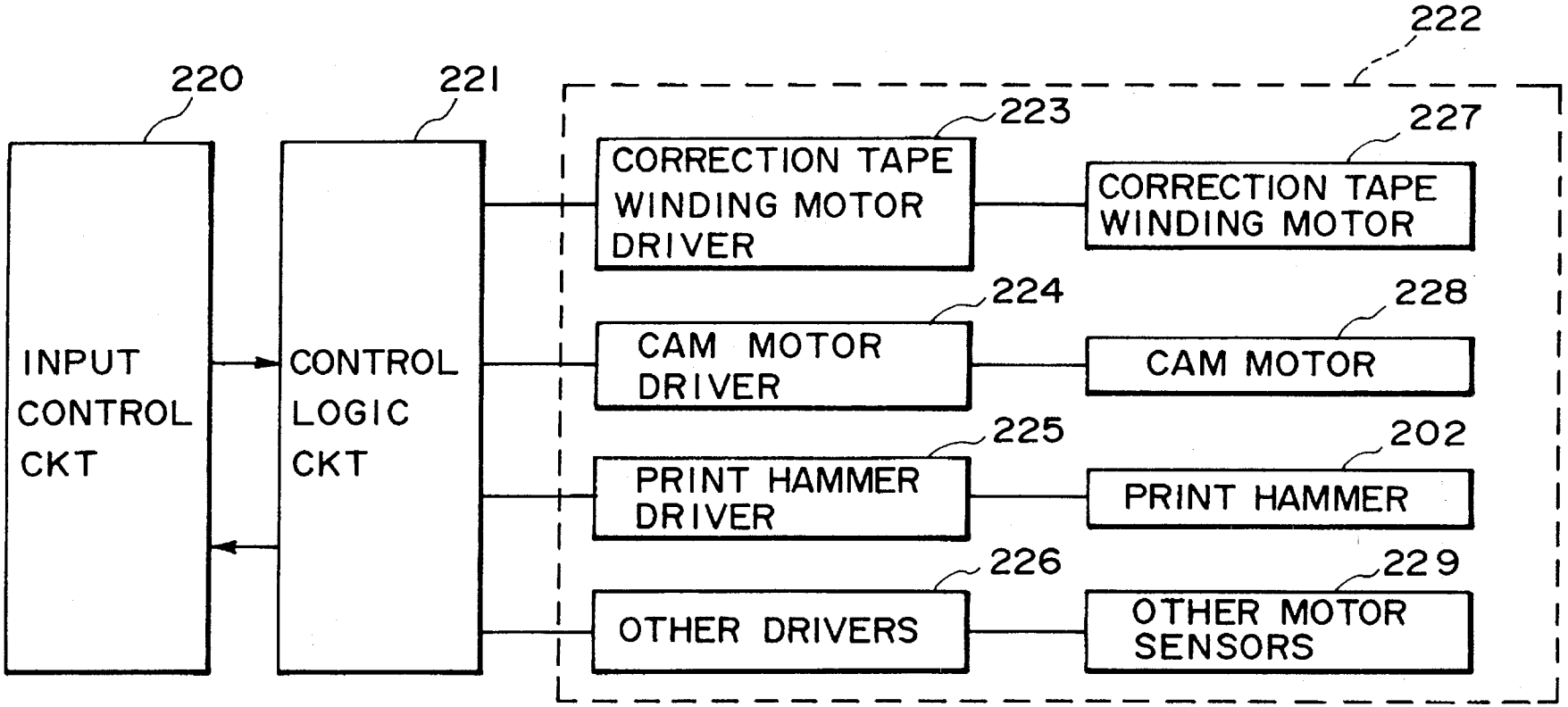
FIG. 9 is a block diagram of the control system of an apparatus which incorporates still another embodiment of the invention.

FIG. 9 is a block diagram of a control circuit for the third embodiment.

As illustrated, an input control circuit 220 is constituted by the aforesaid keyboard 205 and its control circuit. An input control circuit 220 is constituted by various devices such as parallel interface circuits if the apparatus incorporating the third embodiment is not a typewriter but a output device connected as a peripheral device to a host system such a computer system or a word processor.

An control logic circuit 221 which constitutes a main control unit of the apparatus controls a print control circuit 222 in accordance with the data input from the input control circuit 220 thereby causing the circuit 222 to effect a recording operation.

The print control circuit 222 is constituted by drive members and sensors which constitute in combination a print mechanism unit as well as drivers for controlling these components. More specifically, the drive members and sensors are a winding motor 227 for the erasure tape 208, a cam motor 228 for driving the cam 210, the print hammer 202 employing a drive element such as a solenoid, and other motor as well as sensors represented by a block indicated at 229 (for example, a motor for driving the platen 204 and a sensor for detecting printing paper). These components are controlled by drivers 223 to 226.

Figure 10:
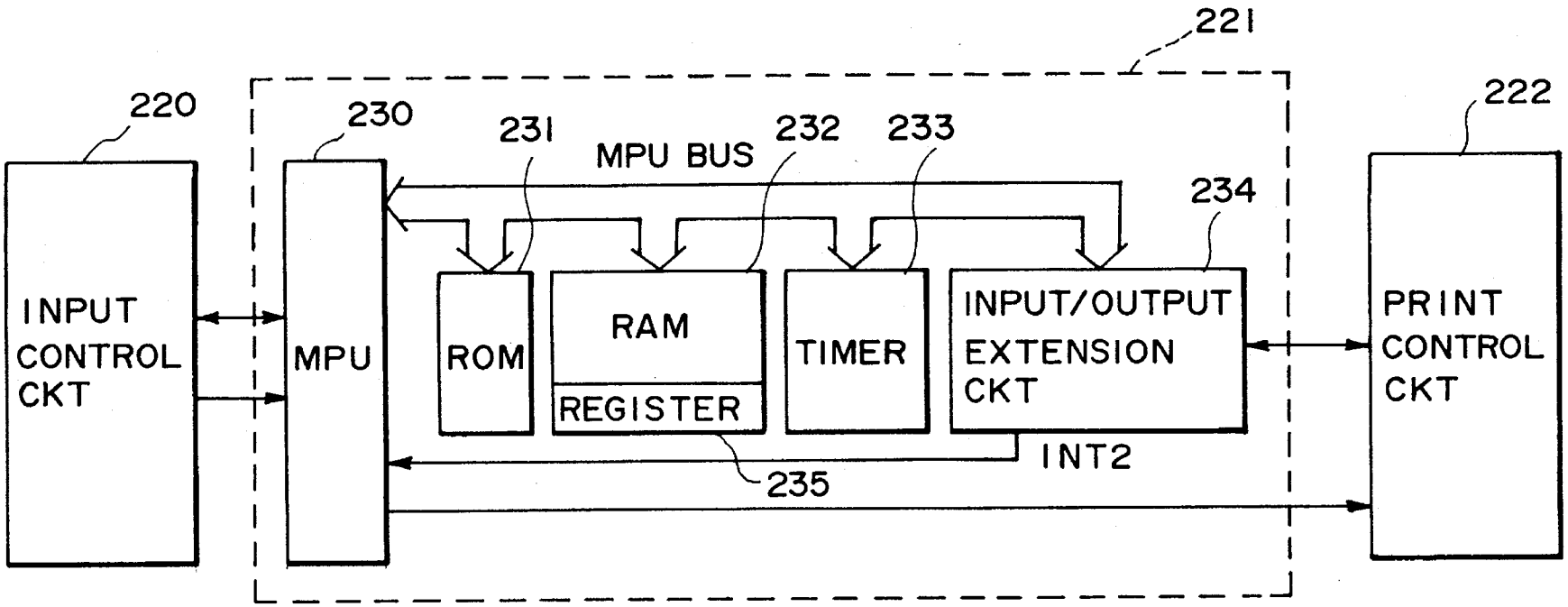
FIG. 10 is a block diagram illustrating the details of the construction of the control logic circuit shown in FIG. 9.

FIG. 10 illustrates in detail the construction of the logic control circuit 221 of FIG. 9.

The logic control circuit 221 is made up of an MPU (micro processor unit) 230, a ROM (read-only memory) 231, a RAM (random access memory) 232, a timer 233 and an input/out extension circuit 234, these components being connected by a MPU bus.

The MPU 230 performs arithmetic operations upon control in accordance with a micro instruction which is previously stored in the ROM 231, thereby outputting an instruction indicative of execution of a recording operation by transmitting and receiving data to and from the input control circuit 220 as well as controlling input and output of data from and to the print control circuit 222.

The timer 233 is controlled by the MPU 230 to perform generation of reference time information, measurement of time passed, and generation of interruption request (INT2) in accordance with timer control conditions, thereby providing control over the control logic circuit in real time.

The ROM 231 stores the program illustrated in a control flow chart which will be described later.

In response to information input from the input control circuit 221 and in accordance with a predetermined control sequence, the control logic circuit 221 controls the drivers 223 to 226 through the input circuits connected thereto so as to drive the cam motor 228 for driving the erasure-tape winding motor 227 and the cam 210 for feeding the tightly disposed portion of the erasure tape 208 in a predetermined direction along the longitudinal axis thereof, a character selecting motor for driving the print hammer 202 and the type wheel 203, and other drive sources and sensors for associated mechanisms, thereby causing the print control circuit 222 to execute a print operation.

The RAM 232 is provided with an area register 235 for storing the kind of type wheel 203 having a different typestyle, and the information relative to the kind of type wheel 203 which has been input through the input control circuit 220 is stored in the register 235. Alternatively, information relative to the kind of type wheel 203 may be automatically detected by means of a sensor to store the information in the register 235. The construction for automatically detecting the kind of type wheel 203 is known and therefore the detailed description thereof is omitted herein.

Figure 11:
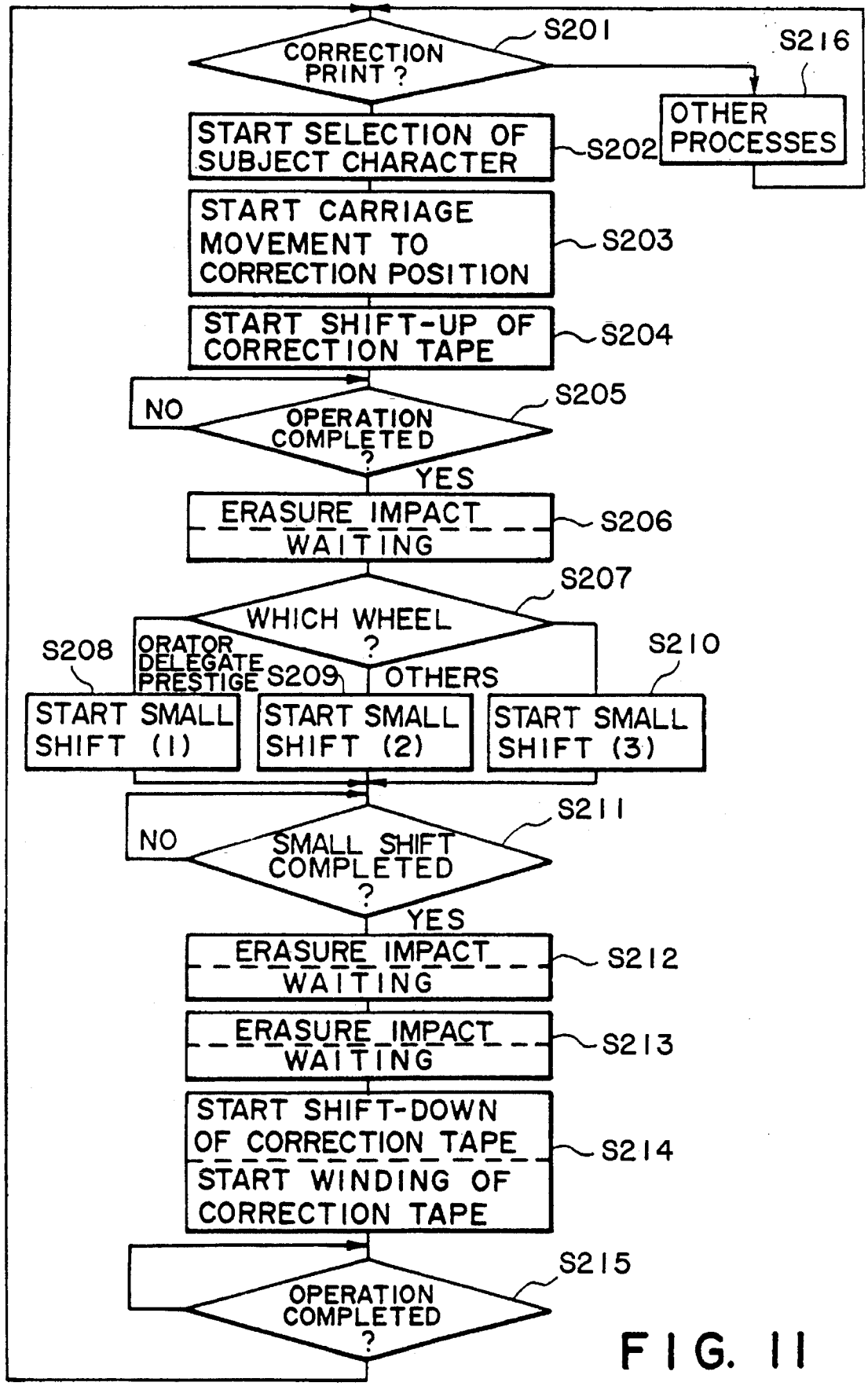
FIG. 11 is a flow chart illustrating the control procedure for the MPUs shown in FIG. 9.

The following is a description of the operation of the entire apparatus which has been described in detail above, taken in conjunction with FIG. 11 which is a flow chart illustrating the character correction program to be executed by the MPU 231 of FIG. 10.

In Step S201, judgement is made as to whether an instruction indicative of print correction (or character erasure) is present. This judgement is made by sensing whether a predetermined key on the keyboard 205 has been operated through the input control circuit 220.

In a case where no print correction instruction is detected, the process proceeds to Step S216 in which other operations such as "print" and "line feed" are controlled. Since this operation control is performed employing known art, the detailed description will be omitted herein.

In a case where a print correction instruction is detected, the character of the type wheel 203 corresponding to a printed character to be erased is selected and the type wheel 203 is driven by the character selecting motor (not shown) so that the desired character to be corrected may be located at a position at which it can properly receive an erasure impact of the print hammer 202.

In Step S203, if necessary, the carriage 201 may be moved to a correction position for correcting the desired character.

Figure 13:
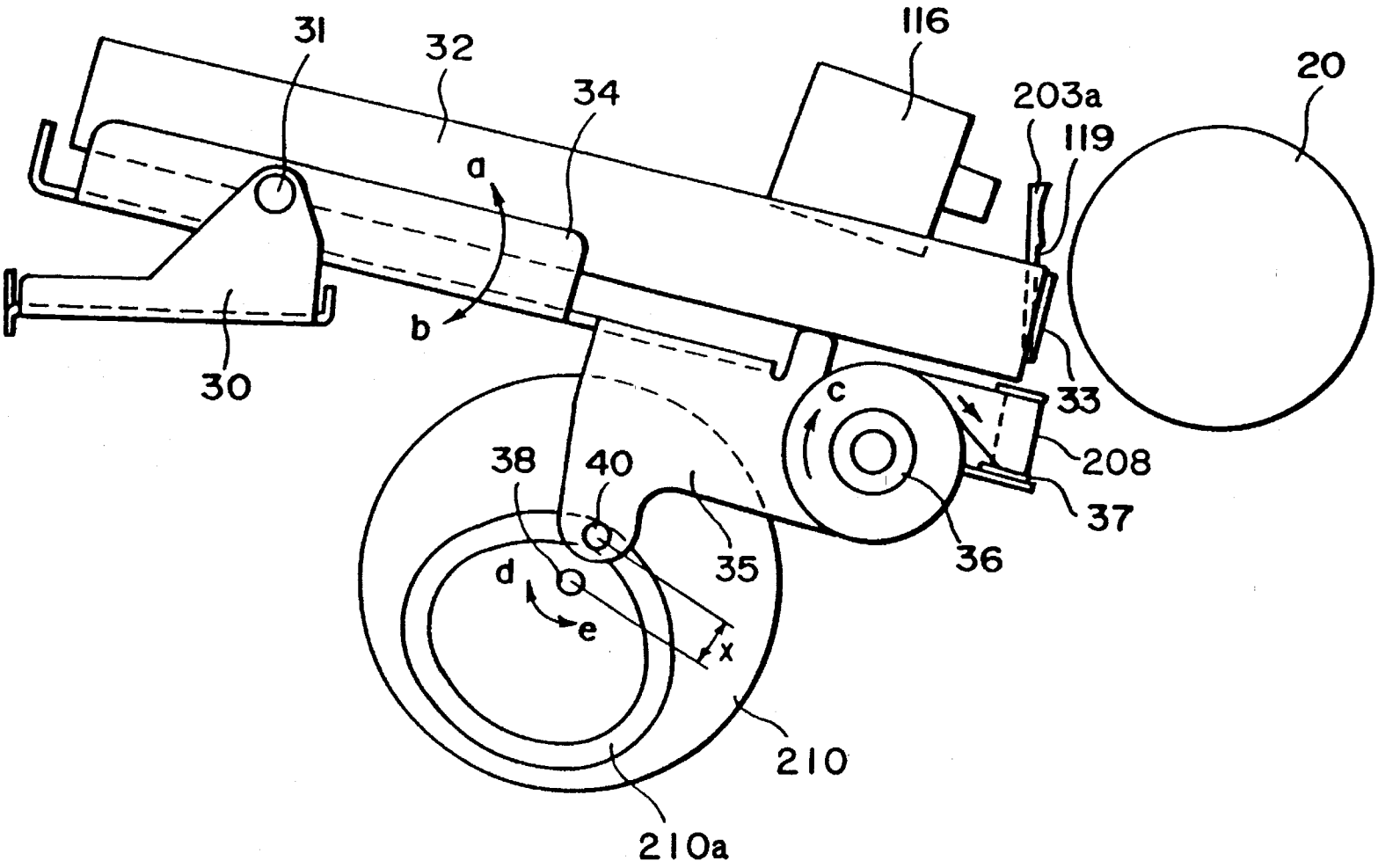
FIG. 13 is a schematic elevational side view a shift mechanism for an inked ribbon and an ersure tape in the present invention, and illustrates a non-print mode in which the ribbon is moved to its lower position.
Figure 14:
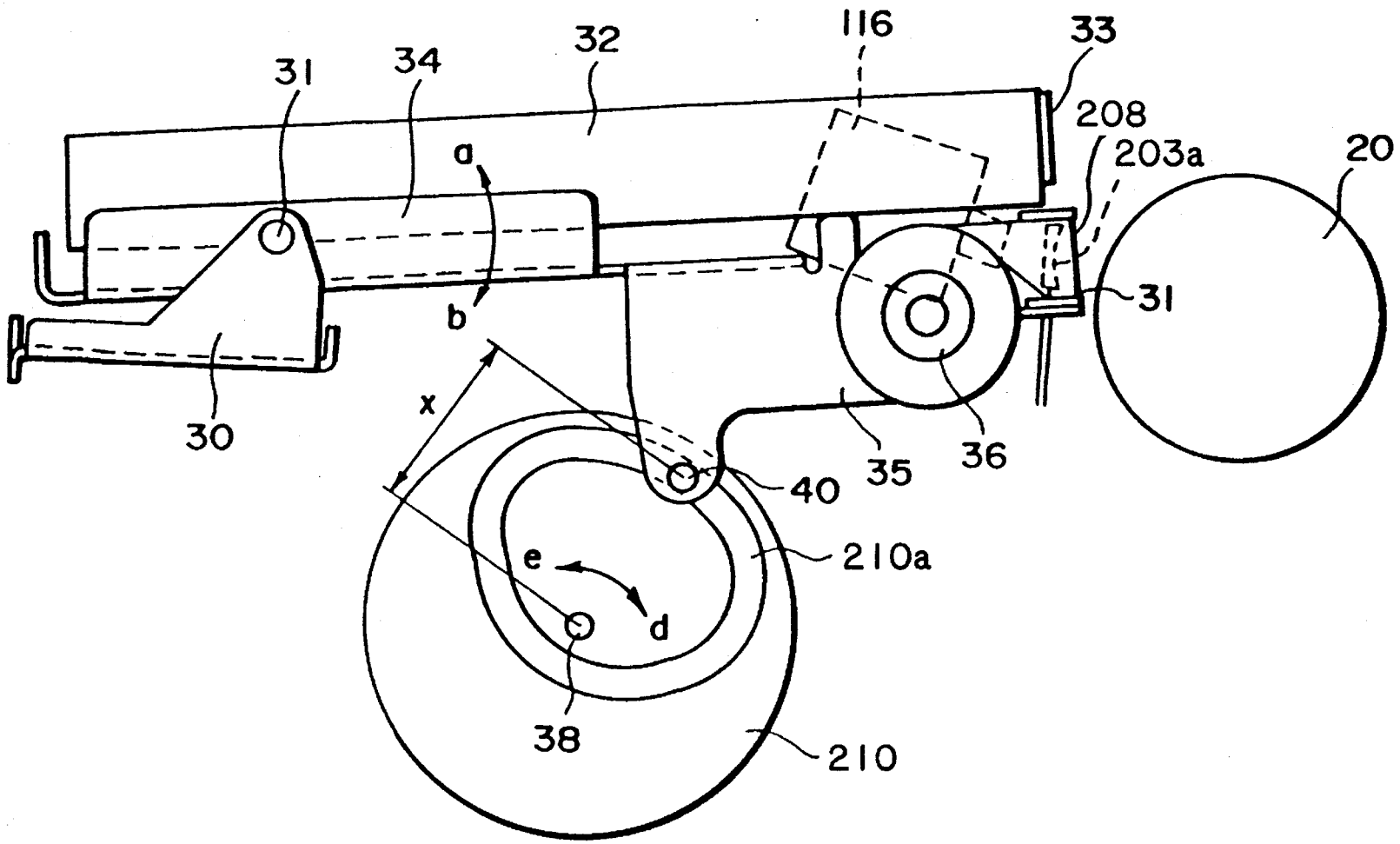
FIG. 14 is a view similar to FIG. 13, illustrating the manner in which the erasure tape is lifted up to a position corresponding to that of a character.

In Step S204, the aforesaid cam 210 and the cam motor 228 are actuated a predetermined amount so that the erasure tape 208 may assume the positional relationship which corresponds to a first application of impact as shown in FIG. 13.

In Step S205, the process waits until the operations executed in Steps S202 and S204 complete.

When the respective operations executed in Steps S202 and S203 have been completed, in Step S206, the print hammer 202 is caused to impact against the back of the character. Thus, as described previously, since the erasure impact is applied to the character erroneously printed on the printing paper through the erasure tape 208, the ink of the printed character is transferred from the paper to an adhesive portion of the erasure tape 208 or alternatively is covered by white ink, thereby performing erasure of the printed character.

In this case, since a portion of the printed character remains unerased as described previously, the erasure tape 208 is shifted a small amount upwardly or downwardly. However, after the erasure tape 208 has completely peeled off following the first application of erasure impact, the amount of shift of the erasure tape 208 is finely and positively controlled in a plane of the erasure tape 208.

In the related art, the correction or erasure tape is shifted a small amount upwardly or downwardly. However, in the third embodiment, in order to vary the amount of shift in accordance with the kind of typestyle, that is, the kind of the type wheel 203, the amount of shift is determined in Step S7 on the basis of the kind of type wheel 203.

In the third embodiment, the amount of shift is controlled with reference to the register 235 in which the kind of type wheel 203 is stored in advance.

It is of course possible to vary the amount of shift for each kind of typestyle of the type wheel 203. However, the third embodiment uses three kinds of typestyle: typestyles such as "orator", "delegate" or "prestige" whose capital height is relatively large; a typestyle such as "micron" whose capital height is relatively small; and other typestyles.

Accordingly, the register may store information which enables identification of each of the three kinds of type wheel. The register 235 may have a storage capacity of at least 2 bits.

In the case where the typestyle of the type wheel 203 is one having a large capital height such as "orator", "delegate" or "prestige" the process proceeds to Step S8 in which the cam 210 is rotated a predetermined amount by the cam motor 228 so that the erasure tape may be shifted a small amount so as to enable the erasure tape to completely cover the capital height.

Also, in the case where the typestyle of the type wheel 203 is one having a small capital height such as "micron", the process proceeds to Step S210 in which the cam 210 is rotated a predetermined amount by the cam motor 228 so that, in order to improve the effectiveness of erasure, the erasure tape may be shifted a somewhat large amount (of course so as to enable the erasure tape to completely cover the capital height).

In a case where the typestyle of the type wheel 203 is one having a middle capital height, the process proceeds to Step S209 in which the cam 210 is rotated by the cam motor 228 a predetermined amount so that the erasure tape may be shifted a middle amount between the aforesaid two amounts.

Accordingly, the small shift is performed in three steps in correspondence with each typestyle of the type wheel 203 attached to the typewrite.

In Step S211, the process waits for completion of the shift operation executed in Step S208 or S209. In Step S212, a second application of erasure impact is performed in a similar manner to that of the previous description. Since the position of the erasure tape is shifted a proper amount in correspondence with the typestyle of the characters of the type wheel 203, the effectiveness of erasure in Step S212 is improved.

In Step S212, the carriage may be moved an extremely small amount to the left or right prior to the second application erasure impact. This fine movement further improves the effectiveness of erasure.

In addition, in a similar manner to that of the second application, after the time period required for the erasure tape 208 to peel from the print paper has passed following the second application of erasure impact, the process returns to Step S213 in which a third application of erasure impact is effected to further improve the effectiveness of erasure.

As a matter of course, prior to the third application of erasure impact executed in Step S213, the sequence of erasure-tape shift control in Steps 7 to 11 may be again executed and the carriage may be moved to the left or right a small amount. In this case, it may be considered that the shift amount realized in each cycle is allocated for the shift amount for two cycles.

Subsequently, after the time period required for the erasure tape 208 to peel from the surface of the print paper has passed, the erasure tape 208 is adapted to move downwardly. It is, therefore, possible to prevent vibration of the erasure tape 208 and hence clinging of the erasure tape 208 to the type wheel 203.

In Step S214, in order to shift down the erasure tape 208, the cam motor 228 is actuated to rotate the cam 210 and at the same time the erasure-tape winding motor 227 is actuated to feed the used portion of the erasure tape a predetermined amount along its length. Thus, a new portion of the erasure tape 208 is fed to the print position in preparation for the next correction or erasure operation. Subsequently, the process waits for the erasure tape 208 to be shifted and for a predetermined length of the erasure tape 208 to be wound. When these operations have been complete, the process returns to Step S201, and the previously-described operation is repeated.

As is evident from the foregoing, the amount of shift of the erasure tape can be controlled in correspondence with three kinds of typestyle or size of characters to achieve a large effect of erasure. For example, even a character such as "orator" having a large capital height can be erased by the erasure tape without remaining partially unerased. In addition, it is possible to prevent a deterioration in the effectiveness of erasure of a character such as "micron" having a small capital height. Accordingly, a stable and proper erasure function can be achieved irrespective of the kind of character.

In the third embodiment, three kinds of typestyle are employed by way of example. However, it will be considered that the amount of shift of the erasure tape is adjusted in accordance with each individual typestyle. The third embodiment is not confined solely to the above-described impact-type typewriter or printer, and may be applied to, for example, thermal transfer printers of the type in which a correction operation is performed employing an erasure tape.

As is evident from the foregoing description, the third embodiment of the recording apparatus of the invention is arranged to perform a plurality of recording operations employing the record head to erase a recorded image through the erasure tape includes means for causing the erasure tape to shift a predetermined amount in a predetermined direction with respect to the record head in each of the plurality of recording operations of the record head; and the present invention is an arrangement provided with means for controlling the amount of shift of the erasure tape in correspondence with the kind of characters recorded. Therefore, in the case of characters having a large capital height, the amount of shift is decreased so as to prevent the occurrence of an unerased portion by completely covering the character with the erasure tape. In the case of characters having a standard capital height, the amount of shift is increased to improve the effectiveness of erasure. Accordingly, the third embodiment provides the merit of enabling a stable proper erasure function irrespective of the kind of character used.

As described in detail above, in accordance with the present invention, it is possible to provide a recording apparatus capable of positively erasing an image recorded on a recording medium.

We claim:

1. An apparatus for recording an image onto a recording medium to be recorded and capable of erasing the image recorded on the recording medium, said apparatus comprising:

a hammer mechanism for impacting a ribbon through a character member;

a mounting section for mounting an erasing member for erasing the image recorded by said hammer mechanism on the recording medium, wherein the erasing member is adapted to be displaced; and means for changing the amount of displacement of said mounting section when said mounting section is displaced a plurality of times to erase the image with the erasing member in response to the kind of ribbon used as the erasing member so as to control the displacement amount of said mounting section to be larger when the ribbon has a higher adhesivity than when the ribbon has a lower adhesivity.

2. An apparatus according to claim 1, wherein the condition is a size of the recorded image.

3. An apparatus according to claim 1, wherein the condition is a kind of a character font to be recorded on the recording medium.

4. An apparatus according to claim 1, wherein the condition is a kind of character wheel used for recording the recording medium.

5. An apparatus according to claim 1, wherein the erasing member comprises a ribbon, and wherein said mounting section is adapted to be displaced in a width direction of the ribbon.

6. An apparatus according to claim 1, wherein the condition is a size of the recorded character and wherein the smaller the size of the recorded character, the larger the displacement of said mounting section.

7. An apparatus according to claim 1, wherein said erasing member comprises an erasing ribbon of the lift-off type and an erasing ribbon of the cover-lap type.

8. An apparatus for recording an image onto a recording medium to be recorded and capable of erasing the image recorded on the recording medium said apparatus comprising:

a hammer mechanism for impacting a ribbon through a character member;

a mounting section for mounting an erasing member for erasing the image recorded by said hammer mechanism on the recording medium, wherein the erasing member is adapted to be displaced; and means for changing an amount of displacement of said mounting section when said mounting section is displaced a plurality of times to erase the image with the erasing member in response to a size of the recorded character so that the smaller the size of the recorded character, the larger the displacement amount of said mounting section.

9. An apparatus according to claim 8, wherein said changing means changes the displacement amount also in response to the kind of a ribbon used as the erasing member and wherein the displacement amount of said mounting section is larger when the ribbon has a lower adhesivity than when the ribbon has a higher adhesivity.

10. An apparatus according to claim 8, wherein the erasing member comprises a ribbon, and wherein said mounting section is adapted to be displaced in a width direction of the ribbon.

11. An apparatus according to claim 8, wherein said changing means also changes the amount of displacement in response to the kind of erasing member.

12. An apparatus for recording an image onto a recording medium to be recorded and capable of erasing the image recorded on the recording medium, said apparatus comprising:

a hammer mechanism for impacting a ribbon through a character member;

a mounting section for mounting an erasing member for erasing the image recorded by said hammer mechanism on the recording medium, wherein the erasing member is adapted to be displaced;

displacing means for displacing said mounting section; and means for changing an amount of displacement of said mounting section by said displacing means when said mounting section is displaced a plurality of times to erase the image with the erasing member in response to the kind of ribbon used as the erasing member so as to control the displacement amount of said mounting section to be larger when the ribbon has a higher adhesivity than when the ribbon has a lower adhesivity.

13. An apparatus according to claim 12, wherein said changing means also changes the displacement amount in response to the size of the recorded image.

14. An apparatus according to claim 12, wherein said changing means also changes the displacement amount in response to the kind of a character font to be recorded on the recording medium.

15. An apparatus according to claim 12, wherein said changing means also changes the displacement amount in response to the kind of character wheel used for recording on the recording medium.

16. An apparatus according to claim 12, wherein the erasing member comprises a ribbon, and wherein said mounting section is adapted to be displaced in a width direction of the ribbon.

17. An apparatus according to claim 12, wherein said changing means also changes the displacement amount in response to the size of the recorded character and wherein the smaller the size of the recorded character, the larger the displacement of said mounting section.

18. An apparatus according to claim 12, wherein the erasing member comprises an erasing ribbon of the liftoff type and an erasing ribbon of the cover-lap type.

19. An apparatus for recording an image onto a recording medium to be recorded and capable of erasing the image recorded on the recording medium, said apparatus comprising:

a hammer mechanism for impacting a ribbon through a character member;

a mounting section for mounting an erasing member for erasing the image recorded by said hammer mechanism on the recording medium, wherein the erasing member is adapted to be displaced; and means for changing an amount of displacement of said mounting section when said mounting section is displaced a plurality of times to erase the image with the erasing member in response to a size of the recorded character so as to control the displacement amount of said mounting section to be smaller when the size is larger and larger when the size is smaller.

20. An apparatus according to claim 19, wherein said changing means changes the displacement amount also in response to the kind of a ribbon used as the erasing member and wherein the displacement amount of said mounting section is larger when the ribbon has a lower adhesivity than when the ribbon has a higher adhesivity.

21. An apparatus according to claim 19, wherein said changing means changes the displacement amount also in response to the kind of character wheel used for recording on the recording medium.

22. An apparatus according to claim 19, wherein the erasing member comprises a ribbon, and wherein said mounting section is adapted to be displaced in a width direction of the ribbon.

23. An apparatus according to claim 19, wherein the erasing member comprises an erasing ribbon of the lift-off type and an erasing ribbon of the cover-lap type.

24. An apparatus for recording an image onto a recording medium to be recorded and capable of erasing the image recorded on the recording medium, said apparatus comprising:

a hammer mechanism for impacting a ribbon through a character member;

a mounting section for mounting an erasing member for erasing the image recorded by said hammer mechanism on the recording medium, wherein the erasing member is adapted to be displaced;

displacing means for displacing said mounting section; and means for changing an amount of displacement of said mounting section by said displacing means when said mounting section is displaced a plurality of times to erase the image with the erasing member in response to a size of the recorded character so as to control the displacement amount of said mounting section to be smaller when the size is larger and larger when the size is smaller.

25. An apparatus according to claim 24, wherein said changing means changes the displacement amount in response to the kind of a character font to be recorded on the recording medium.

26. An apparatus according to claim 24, wherein the erasing member comprises a ribbon, and wherein said mounting section is adapted to be displaced in a width direction of the ribbon.

27. An apparatus according to claim 24, wherein the erasing member comprises an erasing ribbon of the lift-off type and an erasing ribbon of the cover-lap type.

* * * * *

UNITED STATES PATENT AND TRADEMARK OFFICE

CERTIFICATE OF CORRECTION

PATENT NO. : 5,482,392

DATED : January 9, 1996

INVENTOR(S) : SHINYA ASANO, ET AL.

It is certified that error appears in the above-indentified patent and that said Letters Patent is hereby corrected as shown below:

ON THE COVER PAGE:

[63] Related U.S. Application Data

"August 5, 1994," should read --August 5, 1994, abandoned,--.

SHEET 6 OF THE DRAWINGS:

In Fig. 6, in box 123, "MOTOR" should read --MOTOR DRIVER--.

COLUMN 4:

Line 36, "on" should be deleted.

COLUMN 7:

Line 55, "the process a third impact" should read --a third impact occurs--.

COLUMN 10:

Line 33, "rotate" should read --rotated--.

UNITED STATES PATENT AND TRADEMARK OFFICE

CERTIFICATE OF CORRECTION

PATENT NO. : 5,482,392 Page 2 of 3

DATED : January 9, 1996

INVENTOR(S) : SHINYA ASANO, ET AL.

It is certified that error appears in the above-indentified patent and that said Letters Patent is hereby corrected as shown below:

COLUMN 12:

Line 7, "but a" should read --but an--.
Line 9, "such" should read --such as--.
Line 10, "An" should read --A--.

COLUMN 15:

Line 63, close up right margin.

COLUMN 16:

Line 20, "cover-lap" should read --cover-up--.
Line 22, "medium" should read --medium,--.
Line 33, close up right margin.

COLUMN 17:

Line 26, "liftoff" should read --lift-off--.
Line 27, "cover-lap" should read --cover-up--.

UNITED STATES PATENT AND TRADEMARK OFFICE

CERTIFICATE OF CORRECTION

PATENT NO. : 5,482,392 Page 3 of 3

DATED : January 9, 1996

INVENTOR(S) : SHINYA ASANO, ET AL.

It is certified that error appears in the above-indentified patent and that said Letters Patent is hereby corrected as shown below:

COLUMN 18:

Line 14, "cover-lap" should read --cover-up--.

Signed and Sealed this

Sixth Day of August, 1996

*Attest:*

*Attesting Officer*

BRUCE LEHMAN

*Commissioner of Patents and Trademarks*